US005101877A

United States Patent [19]

Subecz et al.

[11] Patent Number: 5,101,877

[45] Date of Patent: Apr. 7, 1992

[54] SHOWER CURTAIN ENSEMBLE

[75] Inventors: Charles J. Subecz, New York, N.Y.; Frederick W. Regnery, Hinsdale, Ill.

[73] Assignee: SRCO Incorporated, Westmont, Ill.

[21] Appl. No.: 583,027

[22] Filed: Sep. 14, 1990

[51] Int. Cl.[5] ..... A47H 1/00

[52] U.S. Cl. ..... 160/330; 16/87.2

[58] Field of Search ..... 160/330, 404, 385, 387, 160/388, DIG. 6; 4/558, 608; 16/87.2, 87.4 R; 248/915; 223/98, DIG. 4

[56] References Cited

U.S. PATENT DOCUMENTS

| | | | |
|---|---|---|---|
| 305,512 | 9/1884 | Courtright | 16/87.2 |
| 1,691,339 | 11/1928 | Deming | 160/330 |
| 2,011,662 | 8/1935 | Thompson . | |
| 2,301,161 | 11/1942 | Gaines . | |
| 2,316,337 | 4/1943 | Kenney | 160/330 |
| 2,417,623 | 12/1944 | Yellin | 16/87.2 |
| 2,989,191 | 6/1961 | Eason | 211/113 |
| 3,321,781 | 5/1987 | Reich | 160/330 |
| 4,058,241 | 11/1977 | Craig | 223/98 |
| 4,120,343 | 10/1978 | Wilson . | |
| 4,126,172 | 11/1978 | Faragher | 160/330 X |
| 4,385,409 | 5/1983 | File | 160/330 X |
| 4,606,482 | 8/1986 | McHugh | 223/DIG. 4 X |

*Primary Examiner*—Carl D. Friedman
*Assistant Examiner*—Korie H. Chan
*Attorney, Agent, or Firm*—Thomas L. Secrest; Donald L. Rhoads

[57] ABSTRACT

A shower curtain ensemble is provided with a curtain member that has a plurality of apertures along the top thereof for engagement by a plurality of plastic hooks that have been covered with a tubular fabric that matches the curtain member and creates the pleasing effect of being completely fabric in appearance. Also, a process for covering the hooks with fabric by initially creating a tube of fabric and slipping it over the hooks is disclosed.

8 Claims, 2 Drawing Sheets

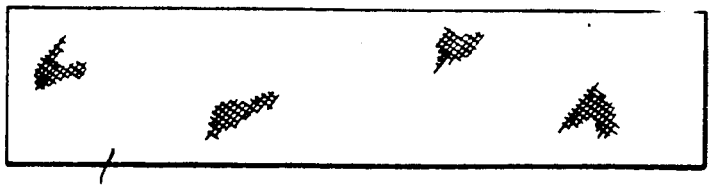
FIG. 2
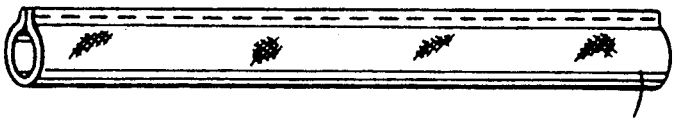
FIG. 2A
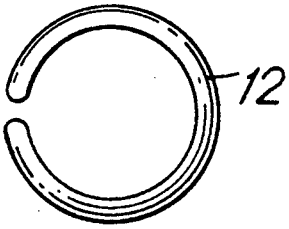
FIG. 3
FIG. 4
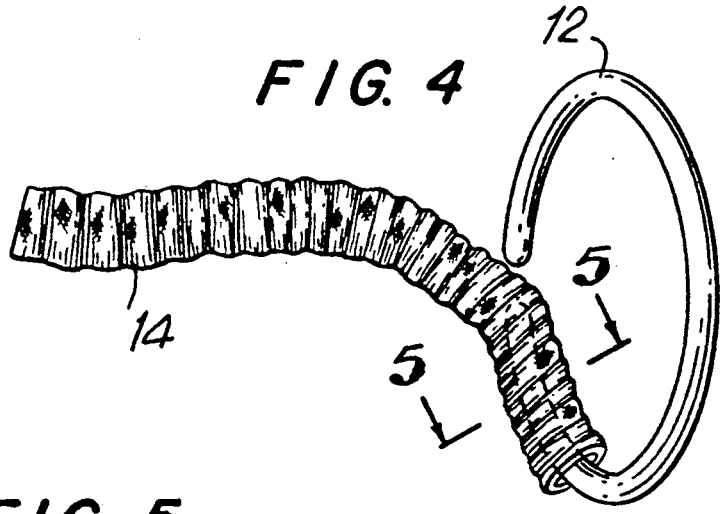
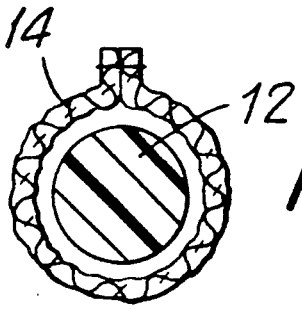
FIG. 5

SHOWER CURTAIN ENSEMBLE

BACKGROUND OF THE INVENTION

The objects of the present invention are accomplished in general by providing a curtain ensemble that includes a flexible sheet of material that is preferably opaque as well as decorative in the form of a shower curtain. The curtain has apertures along the top thereof that can be associated with plastic or metal hooks that have been covered with matching material and associated with a curtain rod and curtain to provide a pleasing effect to a bathroom when the ensemble is installed. Generally, these ensembles are used in stall-type or bathtub enclosures capable of catching water and facilitating drainage out of the enclosure. The invention also includes the process of covering the plastic hooks with fabric by initially creating a tube sized in length and diameter to fit and cover the hooks in a gathered state and thereafter assembling the hooks with the curtain so that only fabric shows to one viewing the ensemble while facing the shower enclosure.

This invention relates to improvements in shower curtains and more particularly is concerned with an ensemble where a fabric shower curtain is held on a curtain rod by a plurality of hook members that are covered with a matching fabric.

Showers intended for bathing purposes generally consist of a spray head positioned at an elevated location within an enclosure capable of catching water and facilitating its drainage away from the enclosure. In stall-type and bathtub enclosures, it is common to utilize a horizontally traversable, flexible curtain to facilitate passage into and out of the shower enclosure. The curtain, when moved to its fully opened position, serves to prevent water from traveling beyond the bounds of the enclosure and, in addition to affording privacy to the user, creates a decorative effect, depending upon the material that is used.

One important disadvantage with maintaining a decorative effect is where hooks are used to hold the shower curtains on the shower curtain rod which generally traverses the enclosure. These hooks are generally made of plastic or metal and do not create a pleasing appearance insofar as they are generally made of a different material than the fabric that is used for the shower curtain. While patents do exist for making the shower curtain and shower hooks of the same material, such as for instance, Wilson, U.S. Pat. No. 4,120,343, as well as Thompson, U.S. Pat. No. 2,011,662, there is no specific teaching in any of these patents of coating or covering an ordinary plastic or metal shower curtain hook with a fabric that matches the shower curtain to create a pleasing effect.

It is, accordingly, an object of the present invention to provide a shower curtain that is held together and supported by a series of metal or plastic hooks on a horizontal shower curtain rod and is covered with the same material for covering the shower hooks as is provided for the shower curtain.

It is another object of this invention to provide an improved process for creating a pleasing appearing ensemble covering a shower stall or the like by first, initially, covering each of the plastic hooks with matching fabric, installing the hooks and thereafter assembling a curtain having matching fabric with each of the hooks in order to support the shower curtain whereby a pleasing, decorative effect in the bathroom is obtained.

These and other objects and advantages of the invention will be apparent from the following description wherein:

DESCRIPTION OF THE DRAWINGS

FIG. 2 is a plan view of a piece of cut material;

FIG. 2*a* is a piece of fabric pictorially illustrated after it has been sewed along a seam to form a tube or cylinder that is sized to be used for covering a plastic hook;

FIG. 3 is a side elevational view of a shower hook;

FIG. 4 is a hook partially covered by a piece of gathered fabric formed into the shape of a flexible tube; and FIG. 5 is a sectional view of FIG. 4 taken on the line 5—5 and looking in the direction of the arrows.

DESCRIPTION OF THE PREFERRED EMBODIMENT

Figure 1:
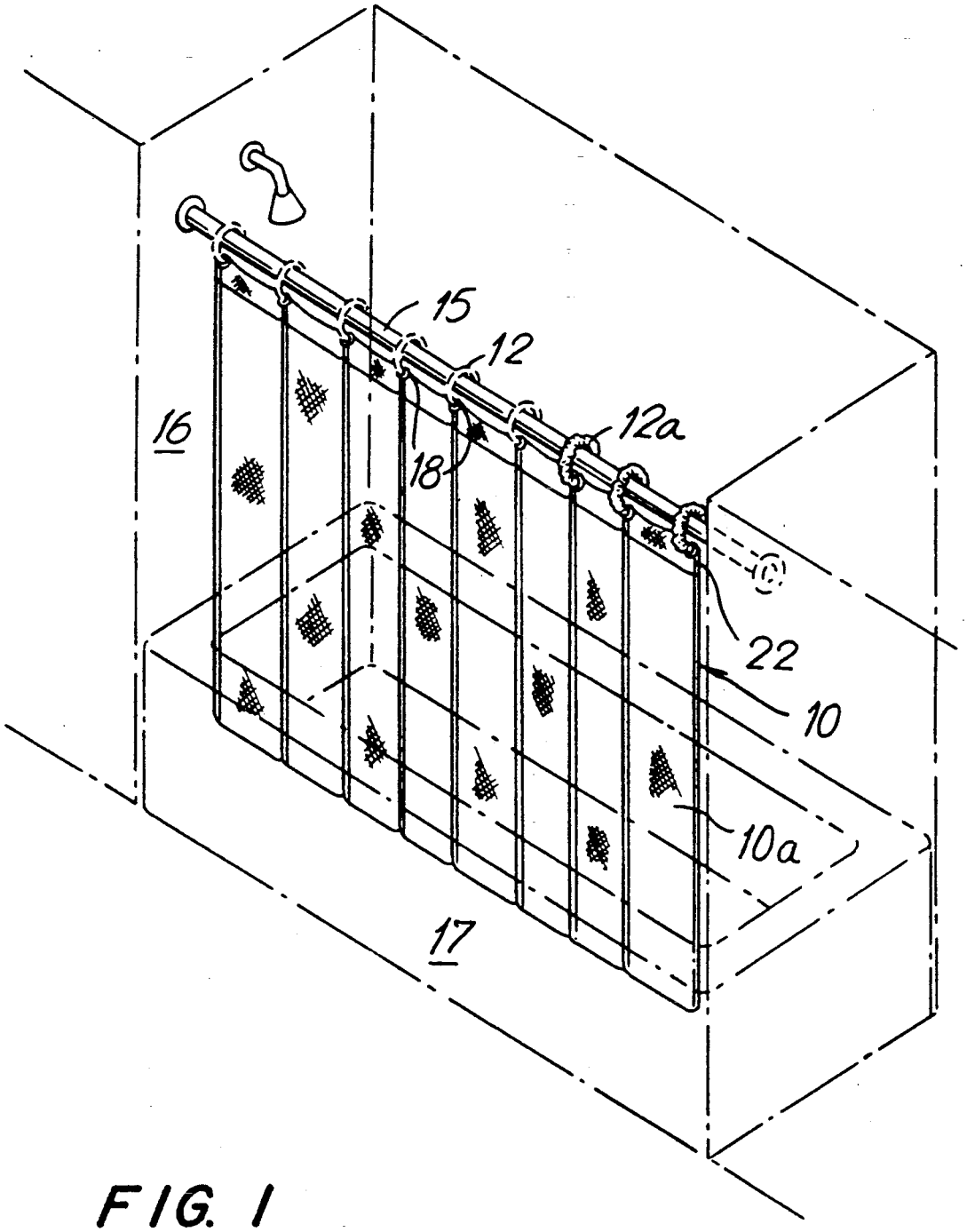
FIG. 1 is a perspective view of an embodiment of a shower curtain ensemble of the present invention in its fully extended position on a curtain rail showing some of the plastic or metal hooks covered with gathered fabric.

Referring to the drawings wherein like characters of reference indicate corresponding parts throughout, FIG. 1 is an assembled shower curtain ensemble 10 of this invention, suspended by a plurality of plastic hooks 12 that have each been covered with a tubular-shaped fabric 14 and is shown suspended by the hooks from the curtain rail 15 extending between the walls 16 facing a bathtub enclosure 17. The shower curtain 10*a*, being made of the same fabric as the covered hooks 12*a*, creates a pleasing appearance to the ensemble in its extended position, since the material shows very well in this position.

As seen from FIG. 3, each of the hooks 12 is substantially cylindrically shaped and bent into the form of a "C" with a small cross section, as shown in FIG. 5, that is sized to fit around curtain rail 15 and through the apertures 18 that are disposed along the top of the curtain, as shown in FIG. 1. Since it is necessary to slide the plastic hooks 12 along the curtain rail 15 when the hooks 12 have been covered by fabric in a gathered state as designated at 14, it is necessary that the hooks 12 with their fabric covering be sized to be slidably associated with the curtain rail 15.

As is common for the apertures 18, the region of the curtain surrounding each aperture should be preferably reinforced to minimize the likelihood that the hole will initiate a tear. In the preferred embodiment, the entire upper edge of the curtain is provided with a reinforced strip 22 where the apertures are located. It is further noted that preferably the curtain is made of a water impervious fabric in order that the water splashing in the bathtub or shower stall enclosure does not escape the enclosure. At any rate, the ensemble can have more than one layer of fabric, just as long as the decorative fabric faces outward of the bathtub or shower enclosure.

Further, in addition to providing the improved ensemble, it can be seen that a new and improved process has been provided wherein ordinary metal or plastic shower hooks are covered and the curtain and shower hooks are assembled with the decorative fabric portion of the ensemble facing outward from the bathtub or shower enclosure. To summarize, pieces of decorative material are cut to a size that enables them to be formed into a substantially cylindrical, tubular shape by sewing them longitudinally along the tube. The tubes are sized for enabling them to then each be slipped over a corresponding hook and gathered along each of the hooks. The covered hooks are then assembled with the curtain rods and are sized to be slidably mounted in relation thereto. The covered hooks suspend the curtain from each of the hooks by putting the hooks through the curtain apertures with the open ends of the hooks facing inward toward the bathtub or shower stall enclosure to achieve a pleasing appearance.

It is noted that while the cross section of the hooks and the tubular fabric are shown as being substantially circular, it should be realized that other cross-sections are contemplated as a part of this invention.

Accordingly, it will be understood that the invention is not to be limited to the specific construction or arrangement of parts shown but that they may be widely modified within the invention as defined by the claims.

What is claimed is:

1. In a shower ensemble having a plurality of hooks that are sized to hang from a curtain rail, in order to suspend an operational shower curtain made of a certain fabric, a plurality of tubular-shaped pieces of fabric that match the fabric of the curtain applied as covering to each of the hooks in order to provide a slidable ensemble and a pleasing effect to a shower enclosure whereby a pleasing effect is portrayed by the ensemble while functioning to contain water within the shower enclosure so the water can be drained through a drainage system in the enclosure rather than end up on the bathroom floor.

2. The shower ensemble of claim 1 wherein C-shaped hooks are provided that can be associated with a curtain rail in a bathtub by being bent at the opening of the "C" in order to slip the rings on a shower rod.

3. The combination of claim 2 wherein the fabric of the shower curtain as well as the hooks are impervious to water.

4. In combination, a plurality of shower curtain hooks, disposed on a curtain rail suspending therefrom an operational shower curtain made of a certain fabric, having a plurality of tubular-shaped pieces of fabric that match the fabric of the curtain for covering each of the hooks in order to provide a slidable curtain and a pleasing effect to a shower enclosure whereby a pleasing effect is portrayed while functioning to contain water within the shower enclosure.

5. The shower curtain hooks of claim 4 wherein the hooks are C-shaped and can be associated with the curtain rail in the shower enclosure by being bent at the opening of the "C" in order to slip the hooks on the curtain rail.

6. The shower curtain hooks of claim 5 wherein the fabric of the shower curtain as well as the hooks are impervious to water.

7. The shower curtain hooks of claim 4 wherein the fabric applied as covering to each of the hooks is in a gathered state.

8. The shower curtain hooks of claim 4 wherein the hooks are made of plastic or metal.

* * * * *